US005396855A

United States Patent [19]

DuBois

[11] Patent Number: 5,396,855

[45] Date of Patent: Mar. 14, 1995

[54] UNDERWATER VEHICLE TAILCONE ASSEMBLY

[75] Inventor: Neil J. DuBois, Cranston, R.I.

[73] Assignee: The United States of America as represented by the Secretary of the Navy, Washington, D.C.

[21] Appl. No.: 268,596

[22] Filed: Jun. 30, 1994

[51] Int. Cl.[6] ..... F42B 19/00; B63H 21/30

[52] U.S. Cl. ..... 114/20.1; 114/20.2; 181/207; 181/208; 181/284; 181/286

[58] Field of Search ..... 114/20.1, 20.2; 181/207, 208, 284, 286; 440/52

[56] References Cited

U.S. PATENT DOCUMENTS

| | | | |
|---|---|---|---|
| 3,335,757 | 8/1967 | Lynch | 138/111 |
| 3,876,034 | 4/1975 | Antonini | 181/208 |
| 4,756,264 | 7/1988 | Ewbank | 114/20.1 |
| 5,158,030 | 10/1992 | DuBois et al. | 114/20.1 |
| 5,337,288 | 8/1994 | Sorathia et al. | 367/1 |

*Primary Examiner*—Charles T. Jordan
*Assistant Examiner*—Theresa M. Wesson
*Attorney, Agent, or Firm*—Michael J. McGowan; Prithvi C. Lall; James M. Kasischke

[57] ABSTRACT

There is presented an underwater vehicle tailcone assembly including a forward flange, a first tubular sheath extending rearwardly from the forward flange, and elastomer material bonded to inner and outer surfaces of the first sheath to form a forward chamber wall. The assembly further includes an aft flange, a second tubular sheath extending forwardly from the aft flange, and elastomer material bonded to inner and outer surfaces of the second sheath to form an aft chamber wall. The assembly still further includes a rigid housing wall disposed between a rearward end of the forward chamber wall and a forward end of the aft chamber wall. The forward chamber wall, the housing wall, and the aft chamber wall form a continuous tailcone wall from a forward edge of the forward flange to a rearward edge of the aft flange.

11 Claims, 2 Drawing Sheets

UNDERWATER VEHICLE TAILCONE ASSEMBLY

STATEMENT OF GOVERNMENT INTEREST

The invention described herein may be manufactured and used by or for the Government of the United States of America for governmental purposes without payment of any royalties thereon or therefor.

BACKGROUND OF THE INVENTION (1) Field of the Invention

This invention relates to torpedoes and other such underwater vehicles and is directed more particularly to a tailcone assembly having means for attenuating vibrations of an underwater vehicle power drive assembly caused by thrust and depth forces acting upon the underwater vehicle power drive assembly.

(2) Description of the Prior Art

When an underwater vehicle, such as a torpedo, is underway, a thrust force is developed by the rotating propellers, and water pressure is exerted against the propellers. Torpedoes typically have been provided with radial and thrust bearings in the afterbody shell of the torpedo to support the drive shaft and to accommodate its associated forces. Such bearings cause the forces to be transferred into the tailcone shell whereupon the forces are passed forward along the torpedo hull. Transference of the forces along the torpedo hull excites the hull and causes vibratory energy resulting from the forces to radiate into the underwater environment, producing undesirable vibrations and noise. Accordingly, the tailcone often serves as an acoustical radiator, radiating noises into the surrounding underwater environment. Such vibrations and noises can contribute to detection of the torpedo or underwater vehicle and provide an opportunity for evasive action or countermeasures.

There is thus a need for attenuation of vibratory energy and acoustical energy in torpedo tailcones to facilitate quieter running to diminish chances of detection.

SUMMARY OF THE INVENTION

It is, therefore, an object of the invention to provide a torpedo tailcone assembly having means for attenuating vibratory and acoustical energy.

With the above and other objects in view, as will hereinafter appear, a feature of the present invention is the provision of an underwater vehicle tailcone assembly. The assembly comprises a forward flange of rigid metallic material, a first tubular sheath of the material extending rearwardly from the forward flange, and elastomer material bonded to inner and outer surfaces of the first sheath and extending around a rearward end of the first sheath to form a forward chamber wall. The assembly further comprises an aft flange of the metallic material, a second tubular sheath of the metallic material extending forwardly from the aft flange, and elastomer material bonded to inner and outer surfaces of the second sheath and extending around a forward end of the second sheath to form an aft chamber wall. The assembly still further comprises a rigid metallic housing wall disposed between a rearward end of the forward chamber wall and a forward end of the aft chamber wall. The forward chamber wall, housing wall, and aft chamber wall form a continuous tailcone wall from a forward edge of the forward flange to a rearward edge of the aft flange.

The above and other features of the invention, including various novel details of construction and combinations of parts, will now be more particularly described with reference to the accompanying drawings and pointed out in the claims. It will be understood that the particular assembly embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
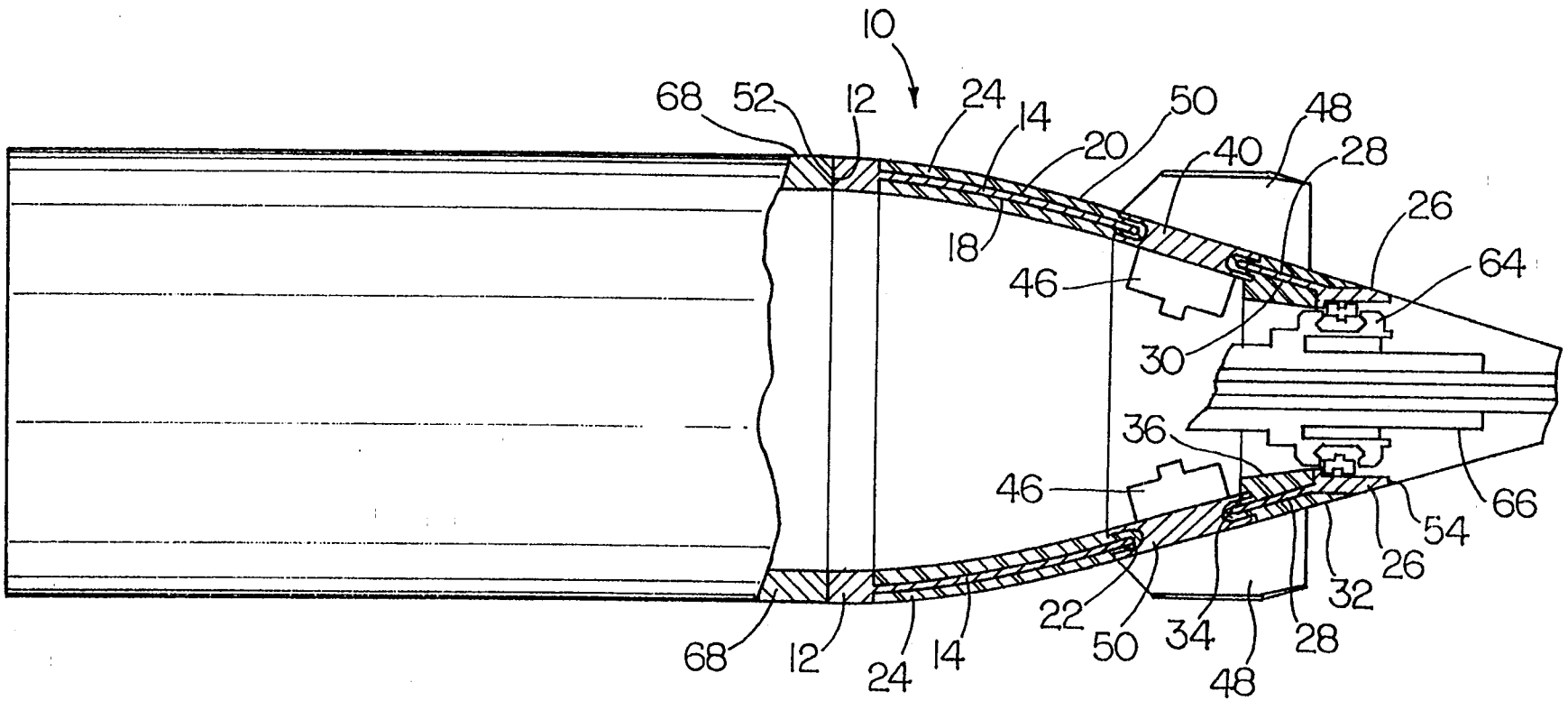
FIG. 1 is a side sectional view of one form of a tailcone assembly illustrative of an embodiment of the invention.

Referring to the drawings, it will be seen that the illustrative tailcone assembly 10 includes a rigid forward flange 12 of metal or metal composite material, preferably aluminum. A first tubular sheath 14 of the same material as forward flange 12, and preferably integral therewith, extends rearwardly from the forward flange. Elastomer material 16 (FIG. 2), preferably polyurethane, is bonded to inner and outer surfaces 18, 20 of the first sheath 14 and extends around a rearward end 22 of the first sheath, to form a forward chamber wall 24.

The tailcone assembly further includes a rigid aft flange 26, preferably of the same material as forward flange 12. A second tubular sheath 28 of the same metallic material as aft flange 26, extends forwardly from aft flange 26 and preferably is integral therewith. The elastomer material 16 is bonded to inner and outer surfaces 30, 32 of second sheath 28 and extends around a forward end 34 of second sheath 28, to form an aft chamber wall 36.

A rigid metallic housing wall 40, preferably of the same material as flanges 12, 26 is disposed between a rearward end 42 of forward chamber wall 24 and a forward end 44 of aft chamber wall 36. The wall 40 forms a mounting surface for control fin activators 46 for positioning control fins 48.

The forward chamber wall 24, housing wall 40 and aft chamber wall 36 form a continuous tailcone wall 50 extending from a forward edge 52 of forward flange 12 to a rearward edge 54 of aft flange 26.

Figure 2:
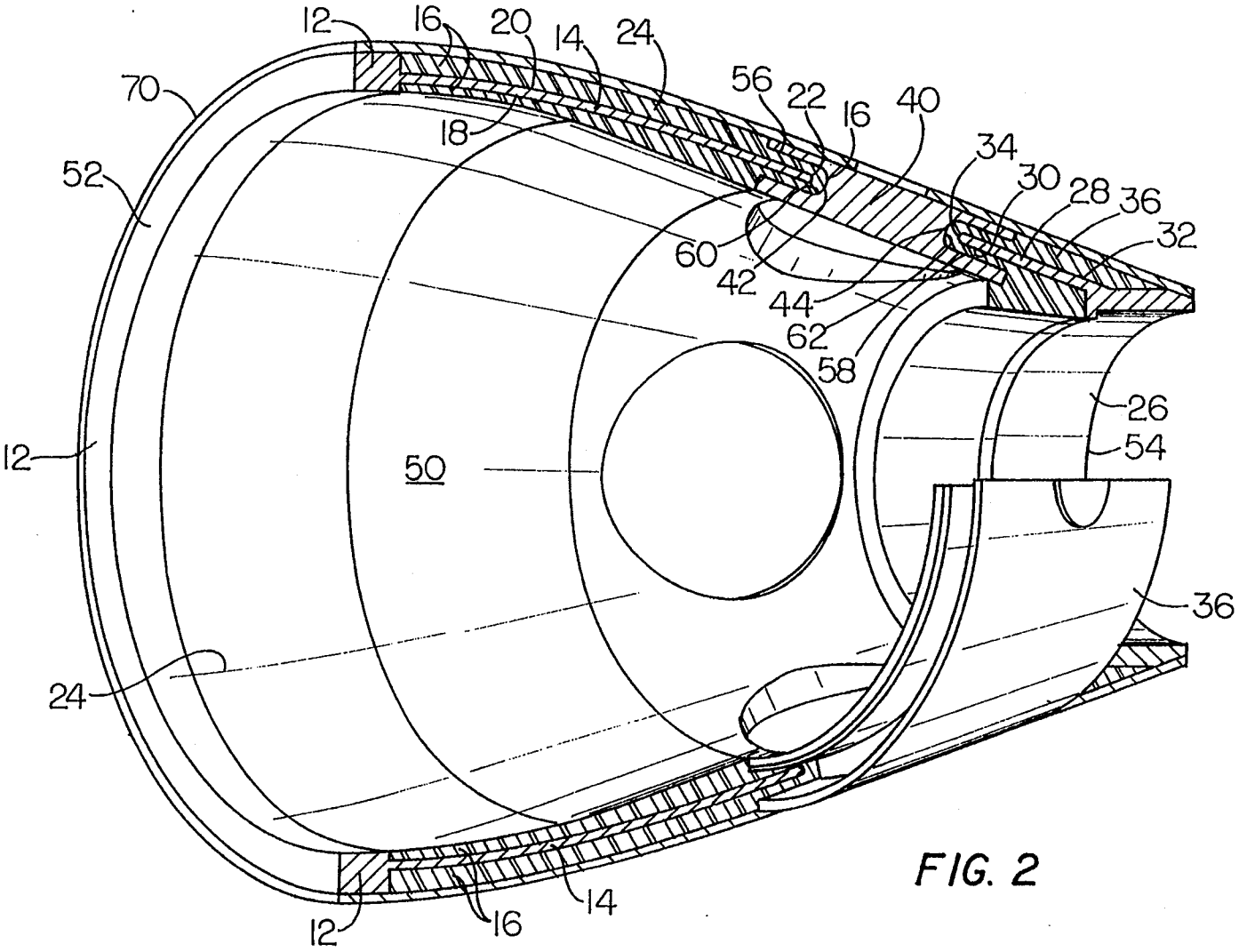
FIG. 2 is a perspective, partially broken away view of the shell of the tailcone assembly of FIG. 1.

Referring to FIG. 2, it will be seen that elastomer material 16 bonded to first sheath 14 and the first sheath form a rearward portion 56 of forward chamber wall 24 of less thickness than the remainder of the forward chamber wall. The elastomer material 16 bonded to second sheath 28, in combination with the second sheath, forms a forward portion 58 of aft chamber wall 36 of less thickness than the remainder of the aft chamber wall. The housing wall 40 is provided with forward and aft recesses 60, 62 for receiving, respectively, the rearward portion 42 of forward chamber wall 24 and forward portion 58 of aft chamber wall 36.

The flanges 12, 26 and sheaths 14, 28 provide the rigidity and strength necessary to prevent the collapse of the elastomer material 16 under pressure.

As is illustrated diagrammatically in FIG. 1, the tailcone assembly includes a flexible seal 64 connected to aft flange 26 and fixed to a drive shaft assembly 66 extending therethrough.

The tailcone assembly 10 is connected to a torpedo afterbody shell 68 and is coated with an acoustic shield 70 (FIG. 2) covering forward chamber wall 24, housing wall 40, and aft chamber wall 36 and serving to attenuate further the noise usually radiated from tailcones.

In operation, the drive shaft assembly is subjected to vibratory energy caused by thrust and depth forces acting thereupon. Such forces are transferred, at least in part, by force transference means to the tailcone assembly. The wall construction of the tailcone assembly described herein serves to attenuate such vibratory energy, and, in addition, to attenuate acoustical energy normally radiated from the tailcone portion of the torpedo.

There is thus provided a torpedo tailcone assembly which attenuates vibrations caused by depth pressure and thrust forces and attenuates noise to provide a quieter running torpedo.

It is to be understood that the present invention is by no means limited to the particular construction herein disclosed and/or shown in the drawings but also comprises any modifications or equivalents within the scope of the claims.

What is claimed is:

1. An underwater vehicle tailcone assembly comprising:

a forward flange of rigid metallic material;

a first tubular sheath of said material extending rearwardly from said forward flange;

elastomer material bonded to inner and outer surfaces of said first sheath and extending around a rearward end of said first sheath to form a forward chamber wall;

an aft flange of said metallic material;

a second tubular sheath of said metallic material extending forwardly from said aft flange;

elastomer material bonded to inner and outer surfaces of said second sheath and extending around a forward end of said second sheath to form an aft chamber wall; and a rigid metallic housing wall disposed between a rearward end of said forward chamber wall, and a forward end of said aft chamber wall, said forward chamber wall, said housing wall, and said aft chamber wall forming a continuous tailcone wall from a forward edge of said forward flange to a rearward edge of said aft flange.

2. The underwater vehicle tailcone assembly in accordance with claim 1 wherein said elastomer material bonded to said first sheath and said first sheath form a rearward portion of said forward chamber wall of less thickness than the remainder of said forward chamber wall, said elastomer material bonded to said second sheath and said second sheath form a forward portion of said aft chamber wall of less thickness than the remainder of said aft chamber wall, and said housing wall having, respectively, forward and aft recesses for receiving said rearward portion of said forward chamber wall and said forward portion of said aft chamber wall.

3. The underwater vehicle tailcone assembly in accordance with claim 2 and further comprising control fin activators mounted on said housing wall.

4. The underwater vehicle tailcone assembly in accordance with claim 2 wherein said rigid metallic housing wall is of aluminum.

5. The underwater vehicle tailcone assembly in accordance with claim 4 wherein said forward flange is of aluminum.

6. The underwater vehicle tailcone assembly in accordance with claim 5 wherein said aft flange is of aluminum.

7. The underwater tailcone assembly in accordance with claim 5 wherein said first sheath is of aluminum.

8. The underwater vehicle tailcone assembly in accordance with claim 6 wherein said second sheath is of aluminum.

9. The underwater vehicle tailcone assembly in accordance with claim 2 wherein said elastomeric material is of polyurethane.

10. The underwater vehicle tailcone assembly in accordance with claim 2 and further comprising a flexible seal connected to said aft flange and fixed to a drive shaft assembly extending therethrough.

11. The underwater vehicle tailcone assembly in accordance with claim 2 and further comprising a coating of acoustic shield material over the external surfaces of said forward chamber wall, said housing wall, and said aft chamber wall.

* * * * *